US006973791B2

(12) United States Patent
Handelsman et al.

(10) Patent No.: US 6,973,791 B2
(45) Date of Patent: Dec. 13, 2005

(54) METHOD AND APPARATUS FOR REDUCTION OF COMBUSTOR DYNAMIC PRESSURE DURING OPERATION OF GAS TURBINE ENGINES

(75) Inventors: Steven Keith Handelsman, Cincinnati, OH (US); Michael Richard Durling, Fort Edward, NY (US); James David Rackmales, Hardy, VA (US); Mark Stephen Lipton, Mason, OH (US); William Lee Barrow, Kings Mills, OH (US); Robert John Pearson, Middletown, OH (US); Ravi Rajamani, West Hartford, CT (US)

(73) Assignee: General Electric Company, Schenectday, NY (US)

( * ) Notice: Subject to any disclaimer, the term of this patent is extended or adjusted under 35 U.S.C. 154(b) by 109 days.

(21) Appl. No.: 10/748,360

(22) Filed: Dec. 30, 2003

(65) Prior Publication Data

US 2005/0144955 A1 Jul. 7, 2005

(51) Int. Cl.[7] ..... F02C 9/00
(52) U.S. Cl. ..... 60/773; 60/725; 60/39.281

(58) Field of Search ..... 60/725, 39.281, 60/772, 773; 431/114

(56) References Cited

U.S. PATENT DOCUMENTS

| | | | | |
|---|---|---|---|---|
| 5,323,604 | A | 6/1994 | Ekstedt et al. | |
| 5,396,760 | A | 3/1995 | Hines | |
| 5,685,157 | A | 11/1997 | Pandalai et al. | |
| 6,354,071 | B2 * | 3/2002 | Tegel et al. | 60/772 |
| 6,742,341 | B2 * | 6/2004 | Ryan et al. | 60/773 |

* cited by examiner

*Primary Examiner*—Ehud Gartenberg
(74) *Attorney, Agent, or Firm*—Armstrong Teasdale LLP; William Scott Andes

(57) ABSTRACT

Methods and apparatus for operating a gas turbine engine without sustained detrimental levels of dynamic pressure are provided. The engine includes a combustor. The method includes determining the combustor acoustic level amplitude, comparing the acoustic level to a predetermined upper acoustic limit, and adjusting a fuel flow distribution to the combustor using a closed loop controller to facilitate reducing the acoustic level to a predetermined lower acoustic limit that is less than the upper acoustic limit.

20 Claims, 4 Drawing Sheets

METHOD AND APPARATUS FOR REDUCTION OF COMBUSTOR DYNAMIC PRESSURE DURING OPERATION OF GAS TURBINE ENGINES

BACKGROUND OF THE INVENTION

This application relates generally to gas turbine engines and, more particularly, to gas turbine combustors.

Air pollution concerns worldwide have led to stricter emissions standards both domestically and internationally. Pollutant emissions from industrial gas turbines are subject to Environmental Protection Agency (EPA) standards that regulate the emission of oxides of nitrogen (NOx), unburned hydrocarbons (HC), and carbon monoxide (CO). In general, engine emissions fall into two classes: those formed because of high flame temperatures (NOx), and those formed because of low flame temperatures, which do not allow completion of the fuel-air reaction (HC & CO). At least some known gas turbines use dry-low-emissions (DLE) combustors that create fuel-lean mixtures that facilitate reducing NOx emissions from the engines while maintaining CO and HC emissions at low levels.

The combustion of the fuel/air mixture inside a gas turbine engine combustor may produce an alternating or dynamic pressure that may be additive to the steady state pressure within the combustor. This dynamic pressure may be referred to as combustor acoustics. Relatively high combustor acoustic amplitudes may result in alternating mechanical stress levels that can damage the combustor, related combustor components and other gas turbine engine hardware. Accordingly, combustion acoustics may undesirably limit the operational range of at least some known lean premixed gas turbine combustors. At least some known DLE combustors may be more prone to generate relatively high acoustic levels than other known combustors because DLE combustor acoustics are primarily a non-linear function of the fuel to air ratio (or flame temperature), radial flame temperature profile, and secondarily of the load and other gas turbine parameters. To facilitate reducing combustion acoustics within DLE combustors, at least some known gas turbine engines utilize adjustment of flame temperature profile. Other known gas turbine engines utilize passive means to facilitate reducing the combustor acoustics. However, because of the relatively large number of operational parameters that may affect combustor acoustic generation, measuring combustor acoustics, arresting combustor acoustics that exceed an acoustic threshold value, and maintaining acoustics below the threshold value may be difficult using passive means.

BRIEF SUMMARY OF THE INVENTION

In one aspect, a method for operating a gas turbine engine is provided. The method includes determining the combustor acoustic level amplitude, comparing the acoustic level to a predetermined upper acoustic limit, and adjusting a fuel flow to the combustor using a closed-loop controller to facilitate reducing the acoustic level to a predetermined lower acoustic limit that is less than the upper acoustic limit.

In another aspect, a combustor control system for controlling combustion acoustics in a combustor wherein the combustor includes a plurality of individually fueled combustor rings is provided. The system includes a combustor acoustics sensor(s) configured in acoustic communication with the combustor, a combustion acoustics control circuit coupled to an output of the sensor(s), the circuit including a closed-loop feedback controller; and a fuel-flow control circuit coupled to an output of the controller wherein the fuel-flow control circuit is configured to control fuel flow distribution between a minimum of two combustor rings.

In a further aspect, a gas turbine engine including a compressor, a turbine coupled in flow communication with the compressor, a combustor system coupled between the compressor and the turbine wherein the combustor system includes a plurality of individually fueled combustor rings, and an engine control system operatively coupled to the combustor is provided. The combustor system including a combustor acoustics sensor(s), a closed-loop combustor fuel control controller coupled to the sensor(s); and a fuel-flow control circuit coupled to the controller, and configured to control fuel flow distribution between a minimum of two combustor rings.

DETAILED DESCRIPTION OF THE INVENTION

Figure 1:
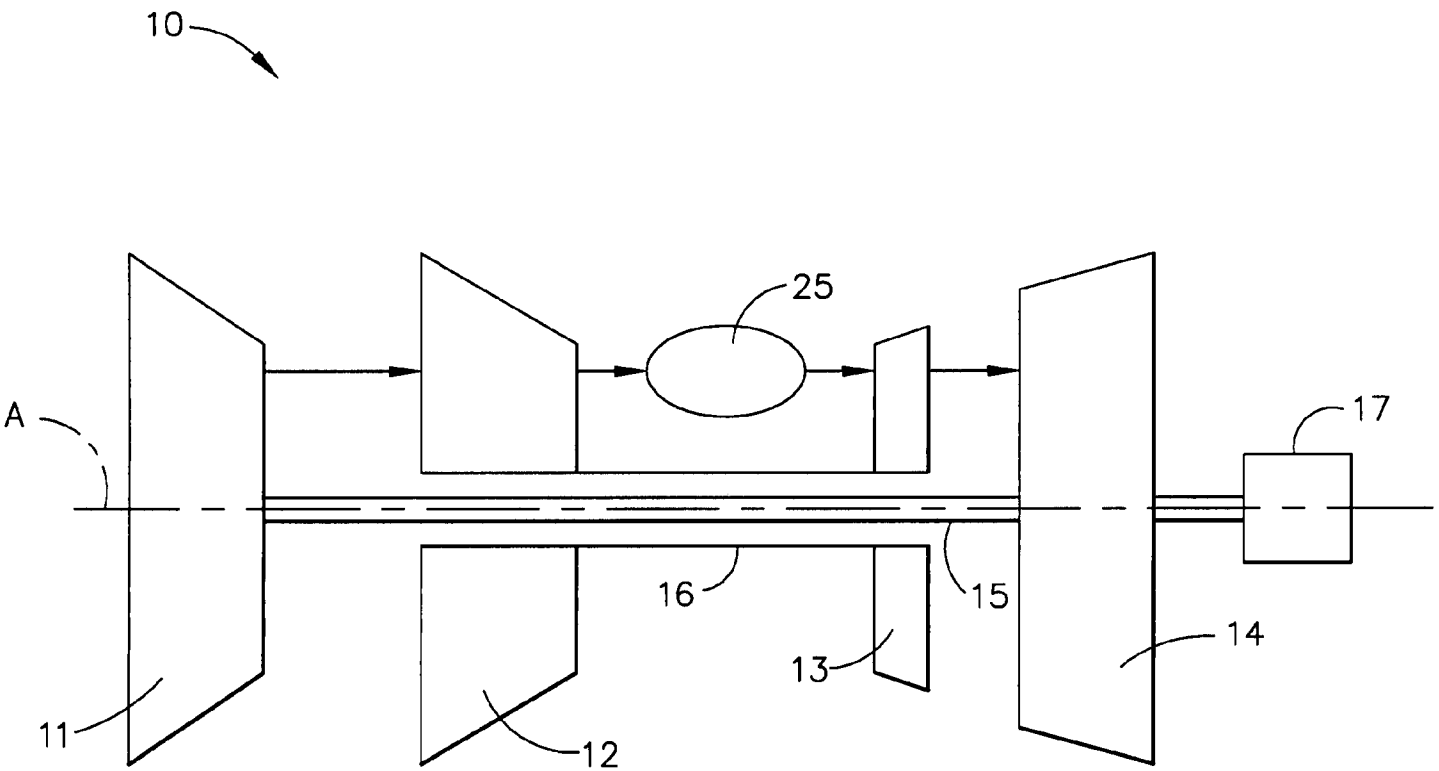
FIG. 1 is schematic illustration of a gas turbine engine.

FIG. 1 is a schematic illustration of a gas turbine engine 10 including a low-pressure compressor 11, a high-pressure compressor 12, a high-pressure turbine 13, and a low-pressure turbine 14. The elements of gas turbine engine 10 rotate about a longitudinal axis A. In the exemplary embodiment, engine 10 is configured in a dual concentric shafting arrangement, whereby low-pressure turbine 14 is drivingly coupled to low-pressure compressor 11 by a shaft 15 and high-pressure turbine 13 is drivingly coupled to high-pressure compressor 12 by a second shaft 16 external and concentric to shaft 15. In gas turbine engine 10, low-pressure turbine 14 is coupled directly to low-pressure compressor 11 and a load 17. A combustor 25 is positioned in series flow relationship between high-pressure compressor 12 and high-pressure turbine 13. In the exemplary embodiment, engine 10 is an LM6000 engine commercially available from General Electric Company of Evendale, Ohio. In an alternative embodiment, engine 10 does not include low-pressure compressor 11 and a forward portion of shaft 15, and uses a free low-pressure turbine, and is an LM2500 engine commercially available from General Electric Company of Evendale, Ohio.

In operation, air flows through low-pressure compressor 11 and compressed air is supplied from low-pressure compressor 11 to high-pressure compressor 12; or in the case of the LM2500 engine, air flows through high-pressure compressor 12. The highly compressed air is delivered to combustor 25. Airflow (not shown in FIG. 1) from combustor 25 drives turbines 13 and 14.

Figure 2:
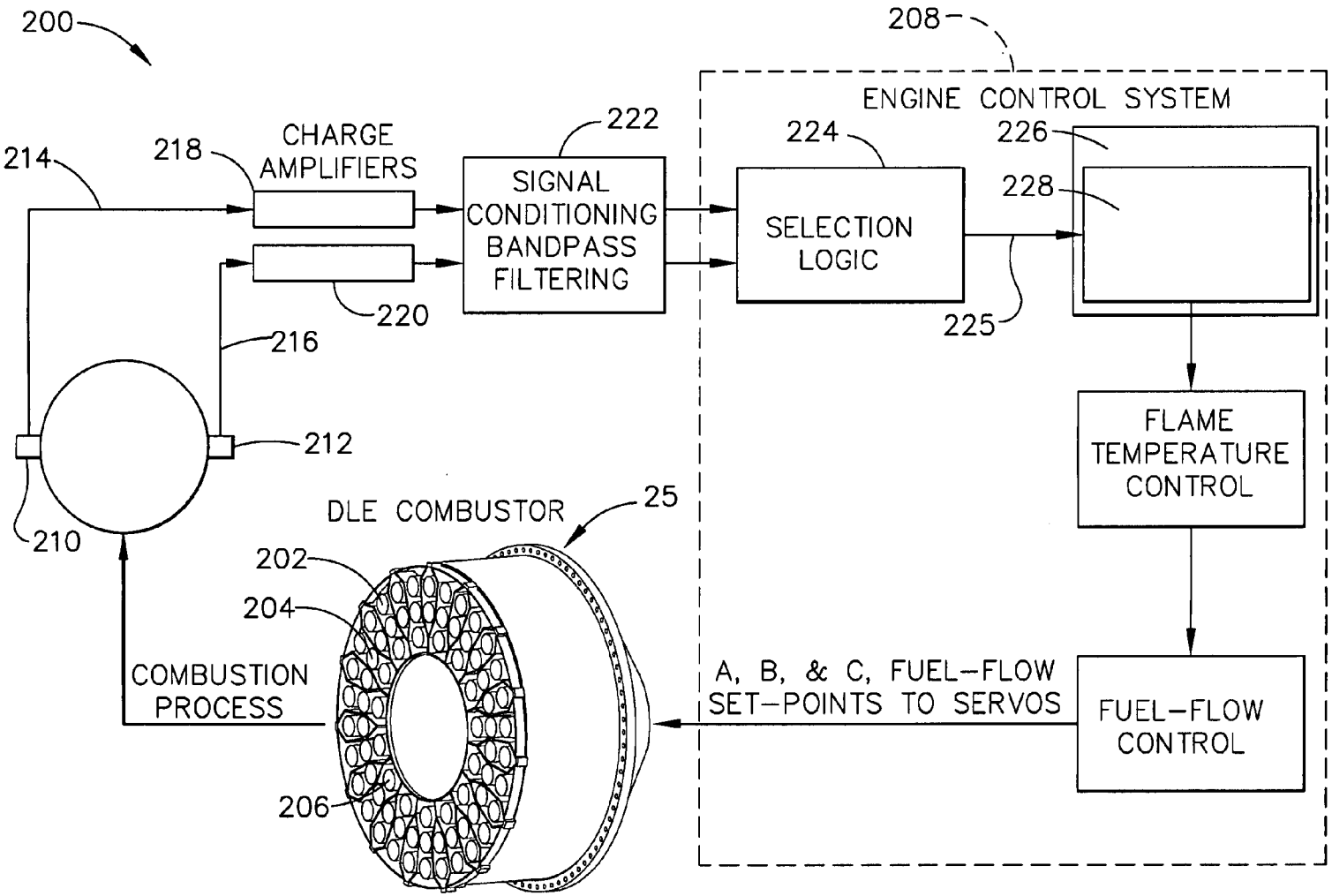
FIG. 2 is a perspective view of a combustor acoustics control system that may be used with the gas turbine engine shown in FIG. 1.

FIG. 2 is a perspective view of a combustor acoustics control system 200 that may be used with gas turbine engine 10 (shown in FIG. 1). In the exemplary embodiment, combustor 25 includes three separately fueled concentric annular rings, an outer, or A, ring 202, a pilot, or B, ring 204, and an inner, or C, ring 206. In an alternative embodiment, combustor 25 includes a pilot ring and one additional ring. Reference flame temperatures (fuel flow) in outer ring 202 and inner ring 206, and a "bulk", or combustor average flame temperature (total fuel flow) are scheduled by an engine control system 208 as a function of compressor discharge temperature and operating mode. The "bulk" flame temperature primarily controls pilot ring 204 flame temperature. The "bulk" flame temperature is a weighted average of the individual ring flame temperatures, which imposes a constraint on the three ring flame temperatures, in effect reducing the degrees of freedom by one. For example, for any given "bulk" flame temperature, any increase or decrease adjustment in the inner or outer ring flame temperature results in a corresponding equal and opposite change in the pilot ring flame temperature.

In the exemplary embodiment, combustor 25 includes two engine mounted combustor acoustic sensors, 210 and 212, which are high temperature capable dynamic pressure transducers mounted to combustor 25. A raw pressure transducer signal, 214 and 216, respectively, from each sensor is amplified using charge amplifiers 218 and 220, respectively. The amplified signals are then filtered using a bandpass filter 222. The resultant analog signals, which are proportional to the average dynamic pressure level within combustor 25, are inputted into engine control system 208. The two signals are validated and combined to a single validated level by logic circuit 224 wherein the selected signal represents a sensed acoustic level 225. An enhanced acoustics/blowout avoidance logic circuit 226 includes a proportional-integral closed-loop controller 228. In the exemplary embodiment, controller 228 is configured to control each of the combustor rings 202, 204, and 206. In an alternative embodiment, controller 228 comprises a plurality of separate controllers that each controls a respective combustor ring. Enhanced acoustics/blowout avoidance logic circuit 226 uses sensed acoustic level 225 to determine whether or not sensed acoustic level 225 is above or below an acoustic threshold value (upper acoustic limit). When sensed acoustic level 225 rises above the threshold value, enhanced acoustics/blowout avoidance logic circuit 226 will attempt to reduce the acoustic level by making incremental decreasing adjustments of the outer ring and/or inner ring flame temperature until sensed acoustic level 225 falls below the threshold value minus a hysteresis amount. Under certain conditions, reducing outer ring 202 and/or inner ring 206 flame temperature may result in an increased acoustic level. In that case, when enhanced acoustics/blowout avoidance logic circuit 226 detects that the sensed acoustic level 225 is rising in response to incremental decreasing adjustments, enhanced acoustics/blowout avoidance logic circuit 226 will change to making incremental increasing adjustments of the outer ring and/or inner ring flame temperature until sensed acoustic level 225 falls below the threshold value minus a hysteresis amount. In the event that enhanced acoustics/blowout avoidance logic circuit 226 cannot abate a rising acoustic level, logic within the engine control will drive a step to a lower power setting whenever the acoustic level rises above set trigger points and persist beyond a set duration.

Figure 3:
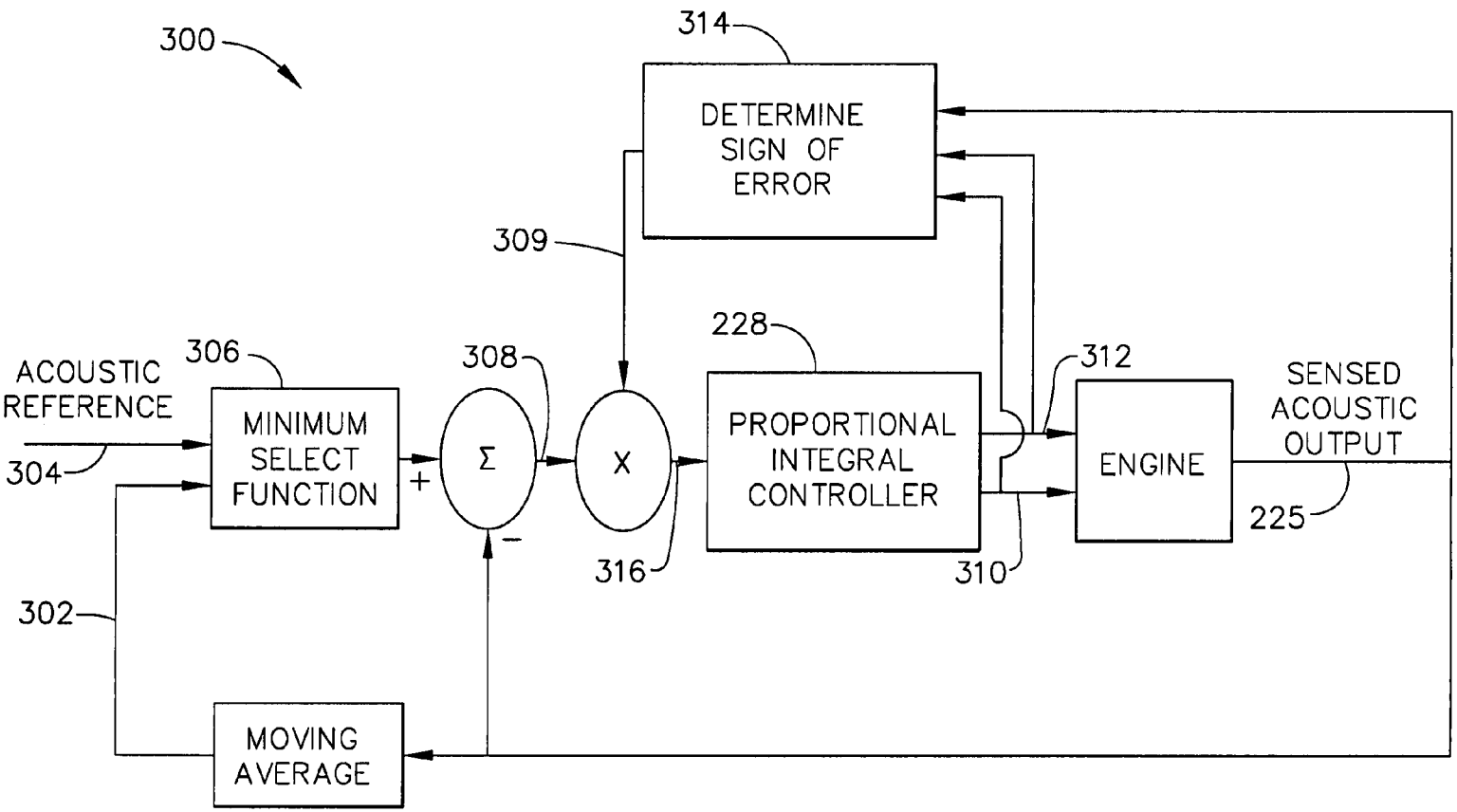
FIG. 3 is a block diagram of enhanced acoustic/blowout avoidance logic feedback control algorithm 300 that may be used with the gas turbine engine shown in FIG. 1.

FIG. 3 is a block diagram of enhanced acoustic/blowout avoidance logic feedback control algorithm 300 that may be used with gas turbine engine 10 (shown in FIG. 1). Enhanced acoustics/blowout avoidance logic circuit proportional-integral closed-loop controller 228 compares a moving average or otherwise filtered measure 302 of sensed acoustic level 225 with an acoustic reference level (acoustic threshold) 304 using a minimum select function 306. Acoustic reference level 304 is a predefined hysteresis band, which facilitates reducing limit cycling of controller 228. Enhanced acoustics/blowout avoidance logic circuit 226 becomes active when moving average or otherwise filtered measure 302 initially exceeds an upper limit of the predefined hysteresis band and turns off when moving average or otherwise filtered measure 302 decreases below the lower limit of the predefined hysteresis band. When moving average or otherwise filtered measure 302 exceeds the upper limit of the predefined hysteresis band, moving average or otherwise filtered measure 302 is subtracted from the acoustic reference level 304 to generate an error term 308. Error term 308 is then multiplied by an adjustment factor 309 defined by the sign (polarity) of the change in sensed acoustic level 225 divided by a change in either an outer ring flame temperature adjustment 310 or a inner ring flame temperature adjustment 312. The sign of the error term is used because in some operational regions of the combustor acoustic envelope, increasing outer ring flame temperature adjustment 310 or inner ring flame temperature adjustment 312 increases sensed acoustic level 225, and in other operating regions increasing outer ring flame temperature adjustment 310 or inner ring flame temperature adjustment 312 decreases sensed acoustic level 225.

For example, when engine 10 is in an operating mode requiring only outer ring 202 and pilot ring 204 to be fired, if high acoustics were to occur, the high acoustics may be caused by either the outer ring 202 or pilot ring 204 flame temperature being too high for the given combustor inlet pressure and temperature and compressor bleed level. Since reducing outer ring 202 flame temperature increases pilot ring 204 flame temperature, the correlation between outer ring 202 flame temperature and sensed acoustic level 225 can be either positive or negative, depending on which operational region the engine is operating. A sign function 314 determines the proper polarity of adjustment factor 309. The appropriately signed error term 314 is transmitted to proportional-integral closed-loop controller 228, which generates an output to either increase or decrease outer ring flame temperature adjustment 310. Outer ring flame temperature adjustment 310 may be adjusted on a continuous basis until sensed acoustic level 225 decreases below the lower limit of the predefined hysteresis band. The most recent adjustment of outer ring flame temperature adjustment 310 will then be maintained for a predefined period of time unless sensed acoustic level 225 rises above the upper limit of the predefined hysteresis band. If sensed acoustic level 225 remains below the upper limit of the predefined hysteresis band during the predefined period of time, adjustment to outer ring flame temperature adjustment 310 will then be ramped out.

In an alternative embodiment, when engine 10 is operating with outer ring 202, pilot ring 204, and inner ring 206 being fired, control of outer ring flame temperature adjustment 310 and inner ring flame temperature adjustment 312 may be more complicated. Separate but dependent controllers, one each for outer ring flame temperature adjustment 310 and inner ring flame temperature adjustment 312 may be employed so that an appropriate control action is taken. When sensed moving average or otherwise filtered measure 302 rises above the upper limit of the predefined hysteresis band, enhanced acoustics/blowout avoidance logic circuit 226 operates either the outer ring flame temperature adjustment 310 or inner ring flame temperature adjustment 312 as described above, and in addition, will alternate between the each adjustment as necessary until moving average or otherwise filtered measure 302 drops below the lower limit of the predefined hysteresis band. Logic circuit 226 uses a set of control laws to change the magnitude and direction of controller 228 adjustments and to switch between adjustments 310 and 312 when the operation of controller 228 times out or is determined to have either no effect or an adverse effect on moving average or otherwise filtered measure 302. The most recent adjustments of outer ring flame temperature adjustment 310 and inner ring flame temperature adjustment 312 will then be maintained for a predefined period of time unless sensed acoustic level 225 rises above the upper limit of the predefined hysteresis band. If sensed acoustic level 225 remains below the upper limit of the predefined hysteresis band during the predefined period of time, adjustments to outer ring flame temperature adjustment 310 and inner ring flame temperature 312 will then be ramped out.

A simplified version of the enhanced acoustics/blowout avoidance logic circuit 226 may be applicable to industrial gas turbine engines using combustors with only two separately fueled concentric annular rings, such as, for example, an LM1600 DLE commercially available from General Electric Company, Evandale, Ohio. Operation of such a simplified version of the enhanced acoustics/blowout avoidance logic circuit 226 would be similar to that described above.

Figure 4:
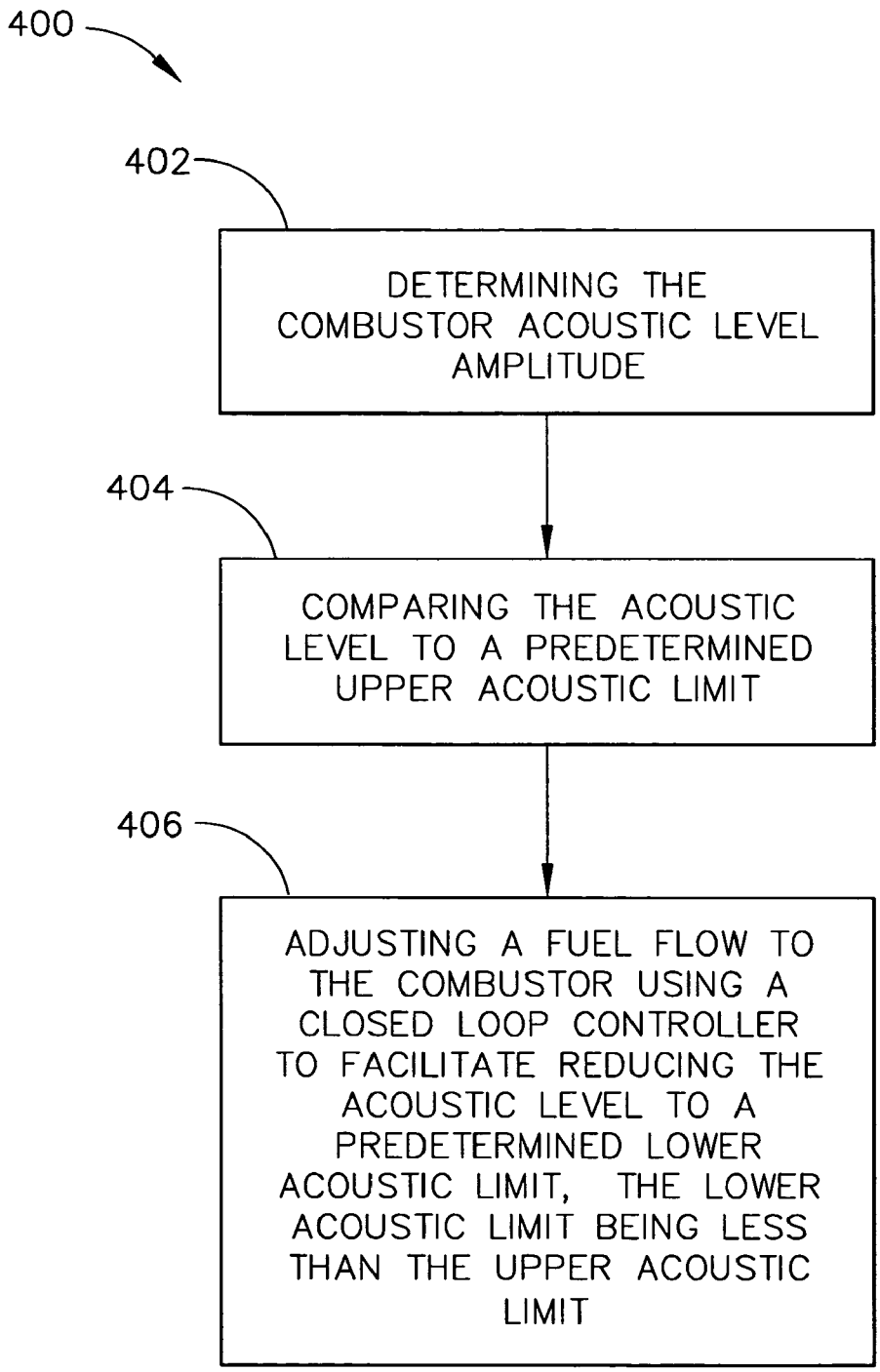
FIG. 4 is a block diagram of an exemplary method of operating the gas turbine engine shown in FIG. 1.

FIG. 4 is a block diagram of an exemplary method 400 of operating a gas turbine engine. The method includes determining 402 combustor acoustic level amplitude. Engine fuel mixtures that are too lean do not permit sustained combustion and ultimately result in a "flame-out" condition commonly referred to as "lean blowout". Lean mixtures having a sufficiently higher fuel to air ratio required to enable sustained combustion, but can result in significant oscillations in both the magnitude of the pressure and the heat release rate within the combustor. This condition, commonly referred to as combustion instability, may cause relatively large oscillations in the magnitude of the pressure within the combustor. The dynamic pressure oscillations may be monitored with a high temperature capable pressure transducer positioned in acoustic communication with the combustor. The sensed magnitude may be transmitted to an engine control system for comparing 404 the acoustic level to a predetermined upper acoustic limit. The limit may be empirically derived and may be related to one or more current operational parameters of the engine. If the sensed acoustic level exceeds the predetermined upper acoustic limit, the engine control system may activate to adjust 406 a fuel flow distribution to the combustor using a closed loop controller to facilitate reducing the sensed acoustic level to a predetermined lower acoustic limit, the lower acoustic limit being less than the upper acoustic limit.

It will be recognized that although the controller in the disclosed embodiment comprises programmed hardware, for example, executed in software by a computer or processor-based control system, it may take other forms, including hardwired hardware configurations, hardware manufactured in integrated circuit form, firmware, and combinations thereof. It should be understood that the enhanced acoustics/blowout avoidance logic circuit disclosed may be embodied in a digital system with periodically sampled signals, or be embodied in an analog system with continuous signals, or a combination of digital and analog systems.

The above-described methods and apparatus provide a cost-effective and reliable means for facilitating significantly improving the avoidance of sustained high levels of combustor acoustics. More specifically, the methods and apparatus facilitate reducing acoustic alarms and power reduction trips due to high acoustic levels in gas turbine engines. As a result, the methods and apparatus described herein facilitate operating gas turbine engines in a cost-effective and reliable manner.

Exemplary embodiments of gas turbine engine monitoring and control systems are described above in detail. The systems are not limited to the specific embodiments described herein, but rather, components of each system may be utilized independently and separately from other components described herein. Each system component can also be used in combination with other system components.

While the invention has been described in terms of various specific embodiments, those skilled in the art will recognize that the invention can be practiced with modification within the spirit and scope of the claims.

What is claimed is:

1. A method for operating a gas turbine engine including a combustor, said method comprising:

determining the combustor acoustic level amplitude based on a signal that is proportional to an average dynamic pressure level within the combustor;

comparing the acoustic level to a predetermined upper acoustic limit; and adjusting a fuel flow distribution to the combustor using a closed loop controller to facilitate reducing the acoustic level to a predetermined lower acoustic limit that is less than the upper acoustic limit.

2. A method in accordance with claim 1 wherein the combustor includes a plurality of separately-fueled, substantially concentric annular burner rings, adjusting fuel flow further comprises alternately adjusting fuel flow to each burner ring using a plurality of separate respective controllers.

3. A method in accordance with claim 2 wherein adjusting a fuel flow to the combustor comprises determining a flame temperature control adjustment for each respective burner ring.

4. A method in accordance with claim 1 wherein determining the combustor acoustic level amplitude comprises determining a filtered measure of the acoustic level amplitude during combustor operations.

5. A method in accordance with claim 1 wherein adjusting a fuel flow to the combustor comprises determining a polarity of a change in a filtered measure of the acoustic level amplitude.

6. A method in accordance with claim 1 wherein comparing the acoustic level to a predetermined upper acoustic limit comprises comparing the acoustic level to a predetermined upper acoustic limit using a minimum select function.

7. A method in accordance with claim 1 wherein the closed-loop controller is a proportional integral controller, said adjusting a fuel flow to the combustor comprises inputting an error signal to the controller that is based on at least one of a polarity of a change in a filtered measure of the acoustic level amplitude, a flame temperature control adjustment, and a filtered measure of the acoustic level amplitude.

8. A method in accordance with claim 1 wherein adjusting a fuel flow to the combustor further comprises:

monitoring the filtered measure of the acoustic level amplitude for a predetermined length of time; and if the filtered measure of the acoustic level amplitude is not reduced at the expiration of the predetermined length of time, then perform at least one of sequentially changing the direction of the controller adjustment, and switching control of fuel flow to another combustor ring.

9. A combustor control system for controlling combustion acoustics in a combustor, the combustor including a plurality of burner rings, said system comprising:

a combustor acoustics sensor coupled in acoustic communication with the combustor;

a combustion acoustics control circuit coupled to said sensor, said circuit comprising a closed-loop feedback controller accepting an input that is proportional to an average dynamic pressure level within the combustor; and a fuel-flow control circuit operationally coupled to said controller, said fuel-flow control circuit controlling fuel flow to at least one combustor burner ring.

10. A combustor control system in accordance with claim 9 wherein said combustor acoustics sensor comprises a high temperature capable dynamic pressure transducer.

11. A combustor control system in accordance with claim 9 wherein said combustor acoustics sensor is configured to generate a sensed combustor acoustic level.

12. A combustor control system in accordance with claim 9 wherein said combustion acoustics control circuit is configured to:

compare a filtered measure of an output of said sensor to an acoustic reference signal to generate an error signal;

determine a polarity of the error signal using the sensed acoustic level and a combustor flame temperature control signal; and transmit the polarized error signal to said closed-loop feedback controller.

13. A combustor control system in accordance with claim 9 wherein said closed-loop feedback controller comprises a proportional integral controller, said combustion acoustics control circuit configured to generate a combustor flame temperature control signal to control fuel flow distribution to the combustor.

14. A combustor control system in accordance with claim 9 wherein said closed-loop feedback controller is configured to control fuel flow distribution to a plurality of separately-fueled, substantially concentrically aligned annular burner rings.

15. A combustor control system in accordance with claim 9 further comprising a plurality of combustor acoustic sensors coupled in acoustic communication with the combustor, said sensor outputs coupled to a signal conditioning bandpass filter, said combustor control system further configured to select at least one filtered sensor output to generate a sensed combustor acoustic level signal.

16. A gas turbine engine comprising:

a compressor;

a turbine coupled in flow communication with said compressor; and a combustor system coupled between said compressor and said turbine, the combustor system including a plurality of combustor burner rings, the combustor system comprising:

a combustor acoustics sensor;

a closed-loop combustor fuel control controller operationally coupled to said sensor and accepting an input that is proportional to an average dynamic pressure level within the combustor; and a fuel-flow control circuit operationally coupled to said controller, the fuel-flow control circuit controlling fuel flow to at least one combustor ring burner.

17. A gas turbine engine in accordance with claim 16 wherein said combustion acoustics control circuit is configured to:

compare a filtered measure of an output of said sensor to an acoustic reference signal to generate an error signal;

determine a polarity of the error signal using a sensed acoustic level and a combustor flame temperature control signal; and transmit the error signal and determined polarity to said closed-loop feedback controller.

18. A gas turbine engine in accordance with claim 16 wherein said closed-loop feedback controller comprises a proportional integral controller, said combustion acoustics control circuit configured to generate a combustor flame temperature control signal to control fuel to the combustor.

19. A gas turbine engine in accordance with claim 16 wherein said closed-loop feedback controller is configured to control fuel flow to a plurality of separately-fueled, substantially concentrically aligned annular burner rings.

20. A gas turbine engine in accordance with claim 16 comprising a plurality of combustor acoustic sensors coupled in acoustic communication with the combustor, said sensor outputs coupled to a signal conditioning bandpass filter, said combustor control system further configured to select a at least one filtered sensor output to generate a sensed combustor acoustic level signal.

* * * * *